United States Patent [19]

Kuhne

[11] Patent Number: 5,059,043

[45] Date of Patent: Oct. 22, 1991

[54] BLAST JOINT FOR SNUBBING UNIT

[75] Inventor: Karl F. Kuhne, Spring, Tex.

[73] Assignee: Vermont American Corporation, Louisville, Ky.

[21] Appl. No.: 342,242

[22] Filed: Apr. 24, 1989

[51] Int. Cl.[5] ..... F16L 11/12

[52] U.S. Cl. ..... 285/45; 285/351; 285/353; 285/357; 285/404; 166/243

[58] Field of Search ..... 285/45, 55, 138, 353, 285/357, 351; 166/243

[56] References Cited

U.S. PATENT DOCUMENTS

| | | | |
|---|---|---|---|
| 1,494,693 | 5/1924 | Loi | 285/404 |
| 4,141,386 | 2/1979 | Bergstrom . | |
| 4,211,440 | 7/1980 | Bergstrom | 166/243 X |
| 4,280,535 | 7/1981 | Willis . | |
| 4,295,666 | 10/1981 | Melanson | 285/357 X |
| 4,423,778 | 1/1984 | Goldsmith | 285/136 X |
| 4,519,634 | 5/1985 | Hand | 285/353 X |
| 4,613,165 | 9/1986 | Kuhne . | |
| 4,685,518 | 8/1987 | Claycomb . | |

OTHER PUBLICATIONS

Pages from Bowen brochure.

*Primary Examiner*—Dave W. Arola
*Attorney, Agent, or Firm*—Middleton & Reutlinger

[57] ABSTRACT

A blast joint for use with a snubbing unit includes a casing around the protective rings and means for sealing around the bottom of the rings between the tubing and the casing.

5 Claims, 3 Drawing Sheets

BLAST JOINT FOR SNUBBING UNIT

This invention pertains to tubing used primarily for oil and gas wells, and, more specifically, to a blast joint for the tubing to be used in connection with a snubbing unit.

BACKGROUND OF THE INVENTION

When an oil or gas well is drilled and the casing is in place, the casing is pierced so the oil or gas can flow into the casing and the well can start producing. A "Christmas tree" is installed at the top of the hole and includes piping and valves. It is made to withstand the high pressures that may be exerted by gases and fluids in the hole.

In order to go back into the hole through the Christmas tree to install tubing once the well is under pressure, it is necessary to use some type of method for balancing that pressure to prevent a blowout. Usually, fluids such as water or denser fluids are used to balance the pressure. This is very expensive, and the use of any fluid tends to damage the geological formation. An alternative which does not require fluid is to use a snubbing unit which is known in the art. The snubbing unit uses rams or seals to seal off tubing strings when moving pipe into or out of a well under pressure.

When oil well tubing is located in an area in which streams of fluid carrying sand impinge on the tubing, holes can quickly be cut in the tubing by the sand-blasting effect. Blast joints have been used in the past to protect the tubing from such sand-blasting action. Blast joints are usually a series of carbide rings stacked up on top of each other to surround the tubing and protect it from the cutting action described above.

Because these blast joints can be fairly long, and because the rings do not provide a pressure seal, these blast joints do not lend themselves to being inserted through a snubbing unit.

Thus, until the present invention, there was no effective way to protect tubing from the cutting action of streams of sand if the tubing was installed through a snubbing unit. Either the tubing would have to be inserted through the snubbing unit unprotected, or a fluid would have to be used to balance the pressure so that a standard blast joint could be used. The substantial opportunity for the fluid to damage the formation and the cost of the fluid itself are factors that often make the second alternative undesirable, and, of course, it is not acceptable to install the tubing unprotected into an area in which it will rapidly be cut by streams of sand.

SUMMARY OF THE INVENTION

The present invention provides a cover or casing which seals against the tubing below the carbide rings of the blast joint and extends upward over the rings. This enables the blast joint to be installed through a snubbing unit.

Thus, the present invention solves the problem of protecting tubing that is to be installed through a snubbing unit.

It permits protected tubing to be installed in a well without damaging the formation and without the need to provide a fluid for balancing the pressure in the well.

DESCRIPTION OF THE PREFERRED EMBODIMENTS

Figure 1:
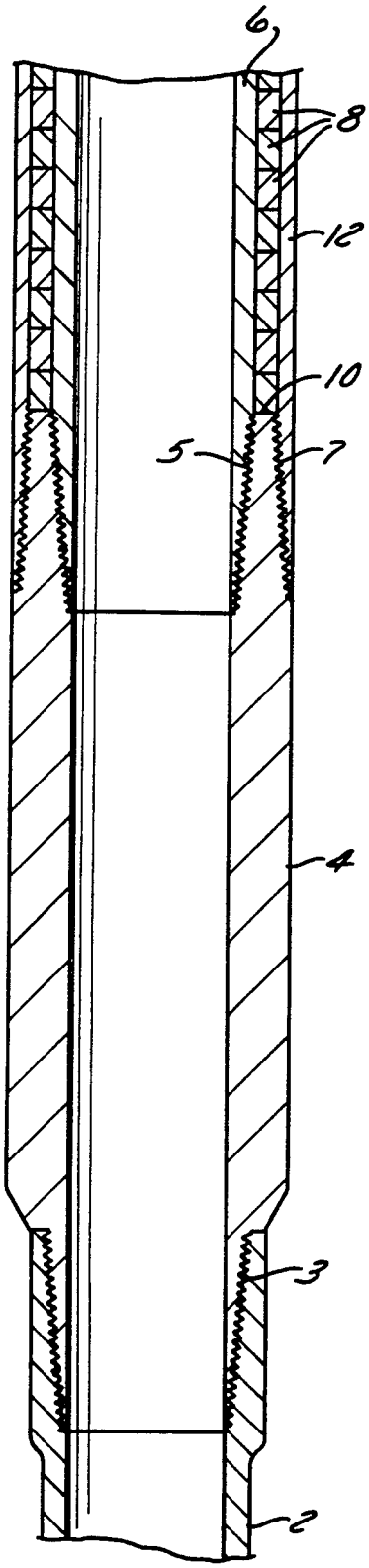
FIG. 1 is a broken-away sectional view of a blast joint made in accordance with the present invention.

The preferred embodiment is shown in FIG. 1, in which the seal is provided as follows:

The regular lower tubing member 2 which is inserted into the hole has internal threads in its upper end and is threaded with a box and pin connection to a crossover subassembly or adapter 4, which has the same inside diameter as the lower tubing member 2 but a much larger outside diameter. The threaded connection 3 between the bottom of the adapter 4 and the top of the lower tubing member 2 provides a pressure seal which cannot be penetrated by the fluid in the well during insertion of the tubing into the well. The crossover subassembly 4 is substantially cylindrical in shape. It is threaded on its outer surface at the bottom end, as already described, and on its top end it is threaded both on its inner surface 5 and its outer surface 7. Its inner surface 5 is threaded to make a box and pin connection to an upper tubing member 6, which is the same size (inside and outside diameters) as the lower tubing member 2. Carbide rings 8 are slipped over the upper tubing member 6 and rest on the top end 10 of the crossover subassembly 4. A tubular casing 12, which has internal threads on its lower end, is then connected to the outside of the upper end of the crossover subassembly 4 in a box and pin connection to make a flush joint, thereby providing a pressure seal below the carbide rings.

Figure 2:
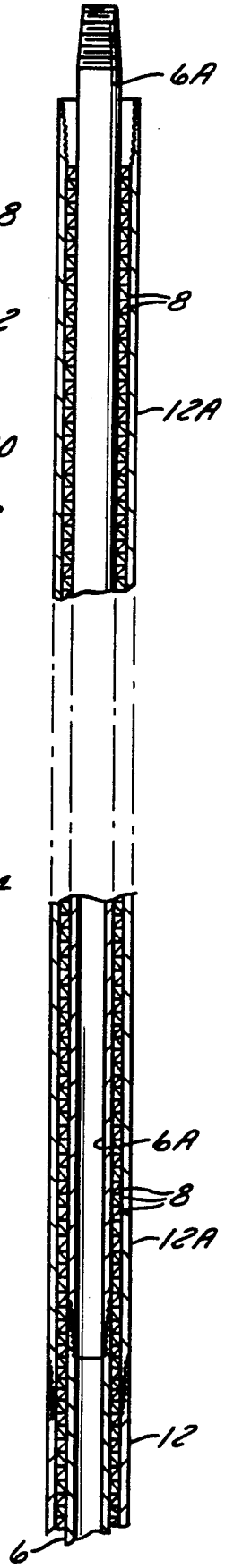
FIG. 2 is a broken-away sectional view showing an upward extension of FIG. 1.

This sealed blast joint can be built up as tall as is needed, as shown in FIG. 2, with joints of inner tubing 6, 6A connecting to each other in a flush box and pin joint and joints of casing 12, 12A connecting to each other in a flush box and pin joint and carbide rings 8 located in between. The end of the inner tubing 6, 6A must always project outside the end of the outer casing 12, 12A so the next joint of inner tubing can be connected before adding protective rings 8 and casing 12.

Figure 3:
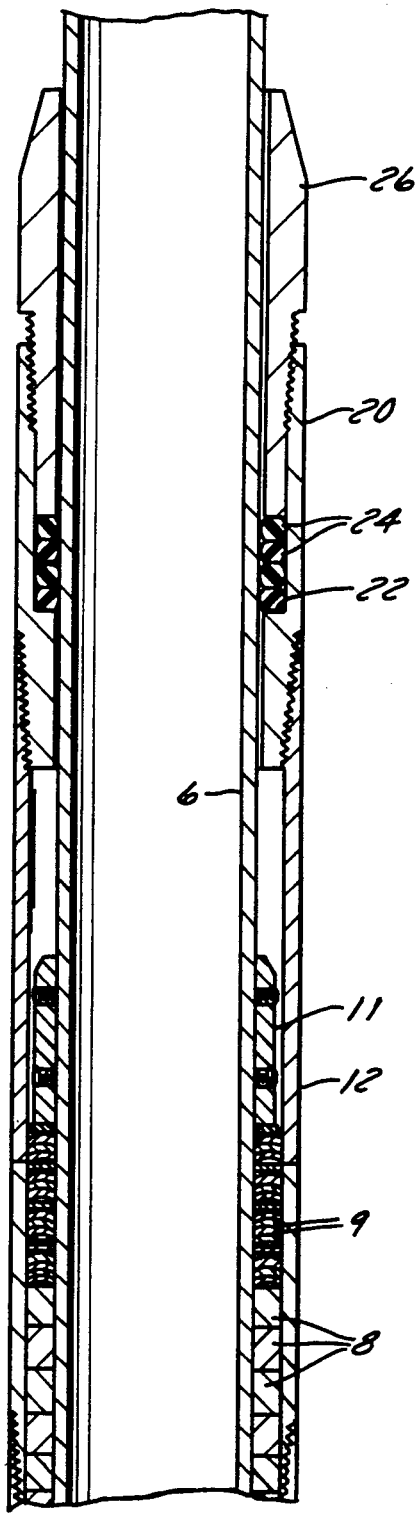
FIG. 3 is a broken-away sectional view of the blast joint of FIG. 1 with a top seal added.

If a seal is wanted at the top of the carbide rings, the parts shown in FIG. 3 can be used. An adapter 20 would be threaded onto the upper end of the casing 12 to form a flush joint. The inside surface of the adapter 20 defines an upward-directed shoulder 22 which holds elastomeric packing elements 24. A compression piece 26 slides over the tubing 6 and is then threaded into the top end of the adapter 20 and compresses the packing elements 24 so they seal against the inner tubing 6, thus sealing off the rings 8 entirely. Such a seal is not generally needed but may be used in special circumstances. It will also be noted that the protective rings 8 are pushed downward by compressed wave springs and washers 9 and that a collar 11 provides an upper limit for the springs 9 and is held in place on the tubing 6 by means of set screws. The wave springs 9 could be another type of spring such as a coil spring but, in any event, should serve to keep the protective rings 8 pressed against one another in abutting relationship so there is no place where the sand-blasting effect can contact the tubing 6 without first cutting through a ring 8.

Figure 4:
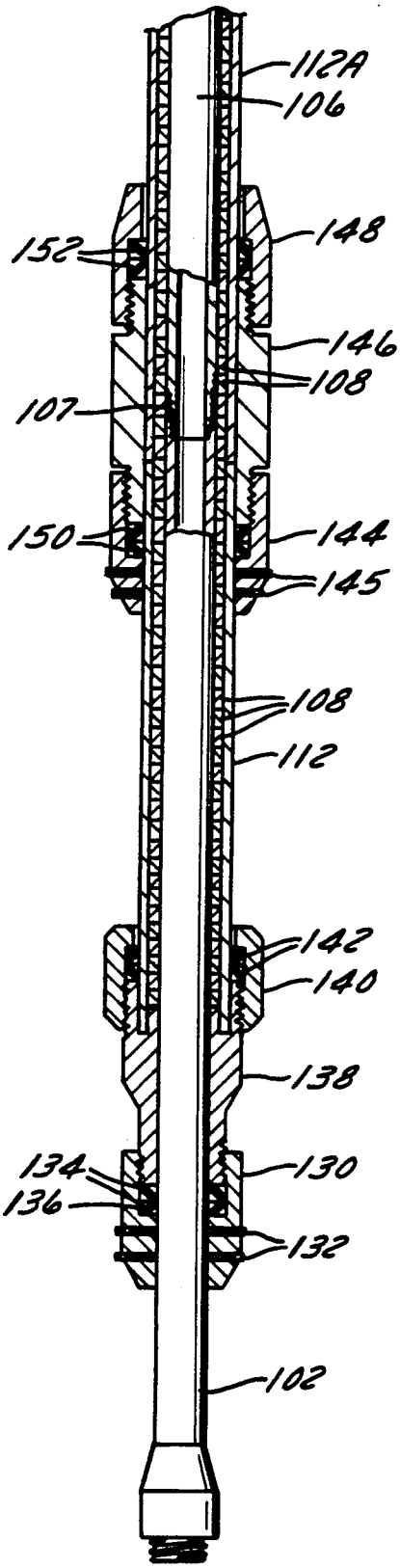
FIG. 4 is a broken-away sectional view of a second embodiment of a blast joint made in accordance with the present invention.
Figure 5:
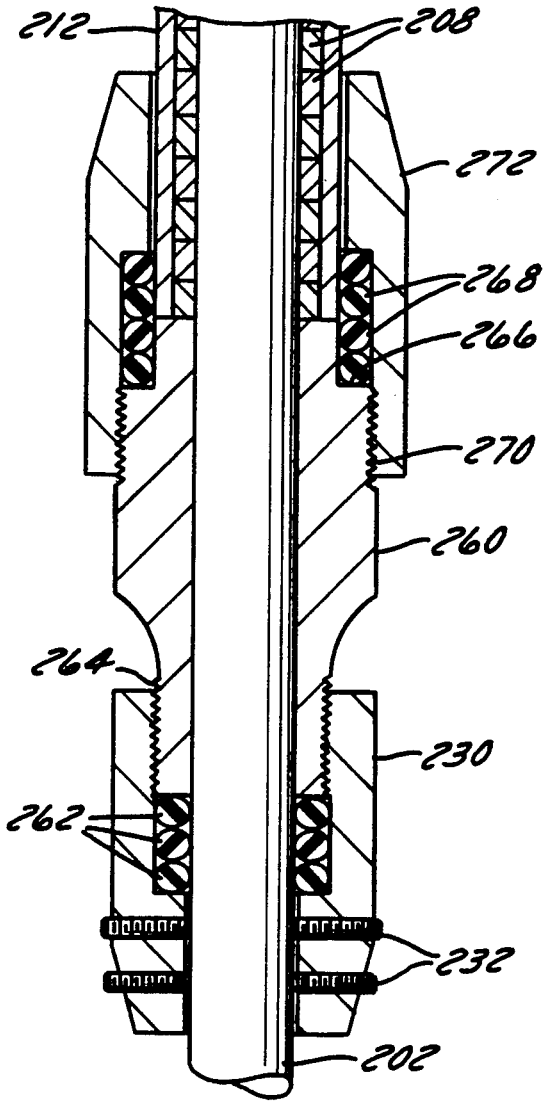
FIG. 5 is an enlarged, broken-away sectional view of the lower portion of a third embodiment of a blast joint made in accordance with the present invention.

Two alternative embodiments are shown in FIGS. 4 and 5. In FIG. 4, a collar 130 is attached to the tubing 102 by means of set screws 132 which extend through holes in the collar 130 and contact the tubing 102. Elastomeric packings 134 rest on a ledge 136 defined on the inside surface of the collar 130. The inside surface of the collar 130 is threaded at its upper end to receive a compression piece 138, which compresses the packing 134 to provide a seal between the tubing 102 and the collar 130. The compression piece 138 has a J-shaped cross-section at its upper end and hooks up underneath the shroud or casing 112, which rests on the bottom of the J. The carbide rings 108 are inside the casing 112, outside the tubing 102, and rest on top of the end of the inner leg of the J on the compression member 138. A second compression member 140 is threaded onto the member 138, compresses the seals 142 which rest on the top of the outer leg of the J of the compression member 138, and seals against the casing 112. The threaded connections between the collar 130 and the compression piece 138 and between the members 138 and 140 are sealed, thus sealing around the lower end of the blast joint.

When the inner tubing 102 has to be connected to another piece of tubing 106, the shroud 112 has to stop. If the shroud does not happen to stop at the right point, the well operators can use a torch to cut the shroud 112 so it ends before the end of the tubing 102. The inner tubing connection is then made up, threading the upper tubing member 106 into the lower tubing member 102 in a standard box and pin flush joint 107. Then another set of rings 108 is installed to cover the joint and the desired portion of the upper tubing member 106; another shroud 112A is slid on and abuts the lower shroud 112, and a seal is made up with members 144, 146, 148 and seals 150, 152 to seal around the discontinuity of the shroud 112-112A. The lower member 144 is connected to the shroud 112 by means of set screws 145. The seals 150 rest on a shoulder defined in the lower member 144 and are compressed by the compression member 146 which is threaded into the lower member 144. The compression member 146 surrounds the connection between the lower and upper shroud members 112 and 112A. The upper compression member 148 is threaded onto the compression member 146, compressing the seals 152 resting on top of the compression member 146, so as to seal against the upper shroud member 112A to complete the seal around the discontinuity in the shroud. As with the first embodiment, it will generally not be necessary to seal around the top end of the rings. However, such a seal may be provided. It could have several configurations. One of the simplest would be for the arrangement to look like the members 144, 146, 148 in FIG. 4 except that the shroud 112 and rings 108 would stop at the point where the shroud 112 stops in FIG. 4, and the upper compression member 148 would cause the seals 152 to seal against the tubing 106.

The second alternative embodiment, shown in FIG. 5, shows a lower collar 230 attached to the tubing 202 by means of set screws 232. The lower collar 230 is identical to the collar 130 of FIG. 4. A compression member 260 is threaded into the collar 230, compressing the seals 262 to provide a seal between the tubing 202 and the collar 230. The threaded connection 264 between the compression member 260 and the collar 230 is also sealed. The upper portion of the compression member 260 defines a shoulder 266 in its outer surface, on which the seals 268 rest. The outer surface 270 of the compression member 260 is threaded to receive a second compression member 272 in sealed engagement. The protective rings 208 and the shroud 212 rest on the upper end of the compression member 260. When the first and second compression members 260, 272 are tightened together, the seals 268 are compressed to provide a seal between the lower compression member 260, the upper compression member 272, and the shroud 212. Thus, as with the previous embodiments, a seal is provided around the lower end of the protective rings 208, which is needed in order to insert the blast joint through a snubbing unit, as will now be described.

Figure 6:
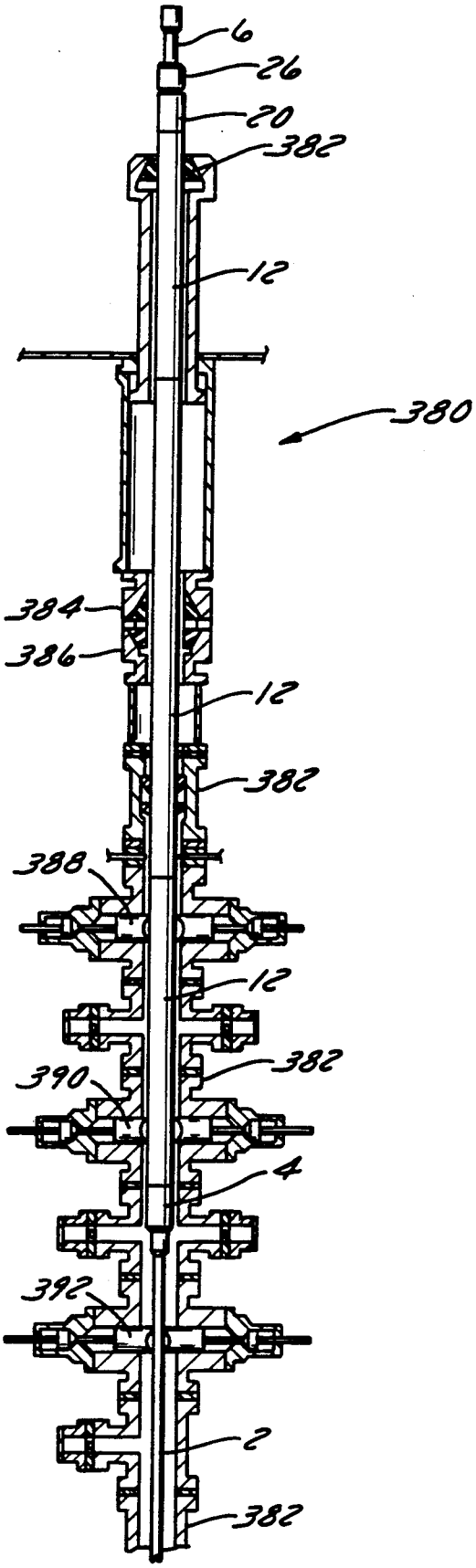
FIG. 6 is a schematic, broken-away sectional view of the blast joint of FIG. 1 being installed into a well through a snubbing unit.

FIG. 6 shows the blast joint of FIG. 1 being installed into a well by means of a snubbing unit 380. The snubbing unit includes a plurality of hydraulic rams or seals located along a string of pipe 382 that is sealingly threaded into the Christmas tree so the pipe 382 serves as an extension of the well casing (not shown). The schematic drawing here shows only three hydraulic seals. Each seal shown in FIG. 6 represents about three seals in the actual installation, because the practice is to have extra seals for additional safety in case one seal fails.

The inside of the tubing 2 is sealed before it is inserted into the well. As the tubing 2 is inserted down into the hole, the upper rams 388 are opened in order to permit the enlarged crossover member 4 and the rest of the blast joint to pass through, while the lower rams 392 are closed, maintaining a seal against the tubing 2. At all times, a sealed chamber is maintained from the inside of the well to whichever set of rams is closed. When the shroud 12 gets down to the large diameter rams 390, the rams 390 are closed to seal against the shroud 12, the lower rams 392 can then be opened to permit the shroud 12 to pass into the well, creating a sealed chamber from the well to the large diameter rams 390. Once the larger diameter shroud 12 has cleared the upper rams 388, the upper rams 388 can again seal against the smaller diameter tubing 6, and the other rams 390, 392 can be opened.

It is generally not necessary to provide a seal around the upper end of the protective rings 8, because, once the upper rams seal around the tubing 6 above the rings 8 and the lower rams open, the entire blast joint is equally exposed to the pressure inside the well, and there is no pressure differential that would tend to separate the rings. However, if a seal were not provided around the bottom of the blast joint, it would be impossible to insert the blast joint into the well unless it were a short enough joint that it would fit entirely between the upper rams and the lower rams. The purpose for sealing around the top of the rings as shown in FIG. 3 would be to prevent sand and fines from settling inside the shroud during producing operation. The presence of sand inside the shroud would make it difficult to disassemble the blast joint, so if it is anticipated that disassembly will be needed after the joint is installed, a seal around the top end might be desirable.

Once the blast joint is inside the well, it will generally present no problem if the streams of sand cut holes in the shroud 12, because the protective rings 8 will remain in position to protect the tubing. The purpose of the shroud 12 is simply to provide a surface against which to seal to enable the blast joint to be inserted through the snubbing unit.

It will be obvious to those skilled in the art that modifications may be made to the embodiments described above without departing from the scope of the present invention.

What is claimed is:

1. A blast joint, comprising:

a lower tubing member;

an upper tubing member;

a plurality of wear-resistant rings concentrically located around the upper tubing member, the rings abutting each other;

an outer casing surrounding at least some of the rings;

a substantially cylindrical adapter for providing a seal between the outer casing and the lower tubing member below the rings, the substantially cylindrical adapter being in threaded, sealing engagement with the lower tubing member and defining inner threads and outer threads at its upper end;

wherein the inner threads of the adapter sealingly engage the lower portion of the upper tubing member; the outer threads of the adapter sealingly engage the lower portion of the outer casing; and the rings are supported by the adapter between the upper tubing member and the casing.

2. A blast joint as recited in claim 1, wherein the inside diameter of said adapter is substantially the same as the inside diameter of the tubing members, and the outside diameter of said adapter is substantially the same as the outside diameter of the casing.

3. A blast joint as recited in claim 2, and further comprising an upper sealing means which provides a seal between said outer casing and said upper tubing member above said rings so as to completely seal off said rings from the atmosphere.

4. A blast joint as recited in claim 3, wherein said upper sealing means comprises:

a shouldered member threadedly and sealingly engaging said casing at the upper end of said casing, said shouldered member having threads at its upper end and defining a shoulder on its upper surface for receiving sealing material;

sealing material surrounding said upper tubing member and resting on said shoulder; and a compression member which threadedly engages said shouldered member, pressing on said sealing material to provide a seal between said shouldered member and said upper tubing member.

5. A blast joint comprising:

a tube;

a plurality of wear-resistant rings concentrically located around said tube, said rings abutting each other;

an outer casing surrounding at least some of said rings; and an adapter including means for sealing between the tube and the outer casing below the rings and means for supporting the rings, wherein the means for supporting the rings includes a flat upper surface on the adapter which is fixed relative to the tube and on which the lowermost ring rests, and the adapter is threaded onto the tube.

* * * * *